US007796094B2

(12) United States Patent
Mtchedlishvili et al.

(10) Patent No.: US 7,796,094 B2
(45) Date of Patent: Sep. 14, 2010

(54) FLEXIBLE ANTENNA MOUNTING ASSEMBLY

(75) Inventors: George Mtchedlishvili, Hallandale, FL (US); Juan B. Delaluz, Miami, FL (US); Anthony M. Kakiel, Coral Springs, FL (US)

(73) Assignee: Motorola, Inc., Schaumburg, IL (US)

( * ) Notice: Subject to any disclaimer, the term of this patent is extended or adjusted under 35 U.S.C. 154(b) by 701 days.

(21) Appl. No.: 11/694,851

(22) Filed: Mar. 30, 2007

(65) Prior Publication Data

US 2008/0238809 A1 Oct. 2, 2008

(51) Int. Cl.
*H01Q 1/50* (2006.01)

(52) U.S. Cl. ..... 343/906; 343/702

(58) Field of Classification Search ..... 343/702, 343/901, 906, 715, 701; 439/916
See application file for complete search history.

(56) References Cited

U.S. PATENT DOCUMENTS 5,478,258 A * 12/1995 Wang ..... 439/581
5,576,720 A 11/1996 Gorenz, Jr. et al.
5,835,071 A * 11/1998 Phelps ..... 343/906
6,215,446 B1 4/2001 Sullivan et al.

FOREIGN PATENT DOCUMENTS

GB 869813 A 6/1961
WO WO9824147 6/1998
WO WO 2006006913 A1 * 1/2006

OTHER PUBLICATIONS

PCT International Search Report Application No. PCT/US2008/056698 dated Nov. 11, 2008—18 Pages.

* cited by examiner

*Primary Examiner*—Douglas W Owens
*Assistant Examiner*—Dieu Hien T Duong
(74) *Attorney, Agent, or Firm*—Barbara R. Doutre

(57) ABSTRACT

A mounting assembly (300) for coupling to a circuit board (180) is provided. The mounting assembly can include a radio frequency (RF) connector (330) for receiving an antenna, a flexible cable (340) connected to the RF connector, and an alignment wall (350) supporting the flexible cable and providing a guide channel (343) to flexibly mount the RF connector to a mechanical housing (190). The alignment wall can limit the movement of the RF connector to within a tolerance to alleviate a solder stress on the circuit board.

22 Claims, 4 Drawing Sheets

FLEXIBLE ANTENNA MOUNTING ASSEMBLY

FIELD OF THE INVENTION

The present invention relates to mobile communications and, more particularly, to antenna mounting fixtures of a mobile unit.

BACKGROUND

Mobile units having an antenna, such as a two-way radio or a vehicle mounted radio, generally include an antenna mounting fixture to support an antenna. As an example, a mobile unit 100 is shown in FIG. 1. The mobile unit 100 can include an antenna 170, an antenna mounting fixture 120, a printed circuit board (PCB) 180, and a mechanical housing 190. The antenna 170 is a detachable antenna external to the mobile unit 100 that connects to the internal antenna mounting fixture 120. The antenna mounting fixture 120 couples signals received by the antenna 170 to radio frequency (RF) components on the PCB 180 within the mobile unit 100. The internal mounting fixture 120 is fixed to the PCB 180 and aligns with an opening of the housing 190 to receive the external antenna 170. The antenna mounting fixture 120 is also precisely positioned on the PCB 180 to correctly receive the antenna 170 through the opening. The antenna mounting fixture 120 must be accurately coupled to both the PCB 180 and the housing 190 to properly receive the antenna 170. Any deviation in the placement of the antenna mounting fixture 120 on the PCB 180, or the attachment of the PCB 180 to the housing 190 can prevent the external antenna 170 from being correctly received.

The conventional antenna mounting fixture 120 of the prior art is shown in FIG. 2. The antenna mounting fixture 120 is a composite assembly that rigidly attaches to the printed circuit board (PCB) 180 within the mobile unit. The antenna mounting fixture 120 includes a RF connector 230, a flange 250, and a support base 240. The support base 240 physically attaches to the PCB 180 to receive the RF antenna signals. The support base 240 can be soldered to the PCB 180 during assembly to provide electrical coupling of the antenna 170 to the RF components on the PCB 180. A pair of support pins 241 provide a secure attachment to the PCB 180. A first ground pin 242 and a second ground pin 244 coupled through the RF connector 130 to the antenna 170 also serve as support pins for rigidly connecting the support base 240 to the PCB 180. A fixed signal pin 246 is also coupled through the RF connector 130 to the antenna 170. The fixed pin 246 is soldered to the PCB board 180 to provide the RF signal to the RF components on the PCB. Notably, the first ground pin 242, the second ground pin 244, and the fixed signal pin 246 are at fixed locations on the support base 240. The rigid attachment of the support base 240 to the PCB limits an allowable tolerance of connection points to the PCB board. In particular, the location of the connections on the PCB must align sufficiently with the pins (242, 244, and 246) on the support base 240. Moreover, if the support base 240 is not properly placed on the PCB 180, or the PCB 180 is not adequately positioned in the housing 190, then the antennae 170 may not properly attach to the antenna mounting fixture 120 thereby leading to mechanical strain. In such regard, the antenna mounting fixture 120, which is rigidly attached to the PCB 180, may generate stress on the PCB 180 which can lead to breaking or electrical failure if the antenna 170 is improperly mounted.

Tolerances for the ground and signal pins of the support base 240 are accounted for in the design of the PCB 180 to ensure electrical coupling compliance. Large tolerances of the connection point locations on the PCB are required to compensate for any deviations in the pin locations of the support base 240. Consequently, larger traces must generally be designed into the PCB 180 to anticipate pin location deviations in the support base 240. The larger traces allow for the pins (242,244,246) of the support base 240 to be aligned with the corresponding connectors on the PCB over a larger area. As a result, the PCB boards are generally larger in size to accommodate for the larger tolerances. The large tolerances do not provide for efficient packaging or miniaturization. A need therefore exists for a robust antenna mounting fixture that requires less design tolerance.

SUMMARY

One embodiment of is directed to a floating assembly. The floating assembly can include a radio frequency (RF) connector for receiving an antenna, a flexible cable connected to the RF connector, and an alignment wall supporting the flexible cable and providing a guide channel for the flexible cable to flexibly mount the RF connector to a mechanical housing. The RF connector can attach to the mechanical housing for receiving the antenna within a tolerance provided by the flexible cable and alignment wall.

A second embodiment is a mounting assembly having a flexible cable attached to a RF connector that provides electrical connection from an antenna to a printed circuit board (PCB), and an alignment wall that mounts to the PCB for supporting the flexible cable and providing a flexibility for mounting of the RF connector to a mechanical housing.

A third embodiment is a floating connector assembly, having a RF connector for receiving an antenna, a flexible cable having a first end connected to the RF connector; and an alignment wall that rigidly connects a second end of the flexible cable to a circuit board. The alignment wall includes a guide channel that provides for a movement of the first end of the flexible cable when the RF connector attaches to a mechanical housing.

A fourth embodiment is a mobile radio having a housing, a circuit board coupled within the housing, a first antenna, and a first floating connector assembly providing non-rigid coupling of the first antenna to the circuit board. A second floating connector assembly can be coupled within the housing for receiving a second antenna to provide multi-band operation to the mobile radio.

BRIEF DESCRIPTION OF THE DRAWINGS

The features of the system, which are believed to be novel, are set forth with particularity in the appended claims. The embodiments herein, can be understood by reference to the following description, taken in conjunction with the accompanying drawings, in the several figures of which like reference numerals identify like elements, and in which:

DETAILED DESCRIPTION

Figure 1:
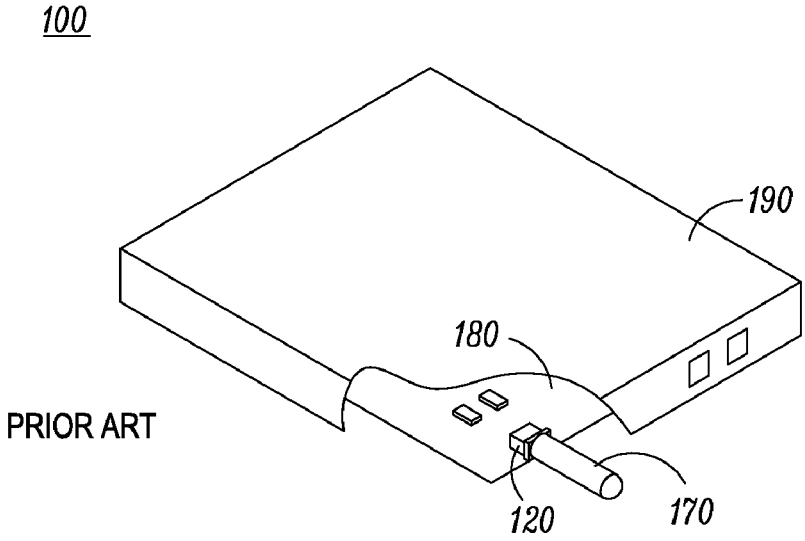
FIG. 1 is a conventional mobile unit showing an internal antenna mounting fixture.
Figure 2:
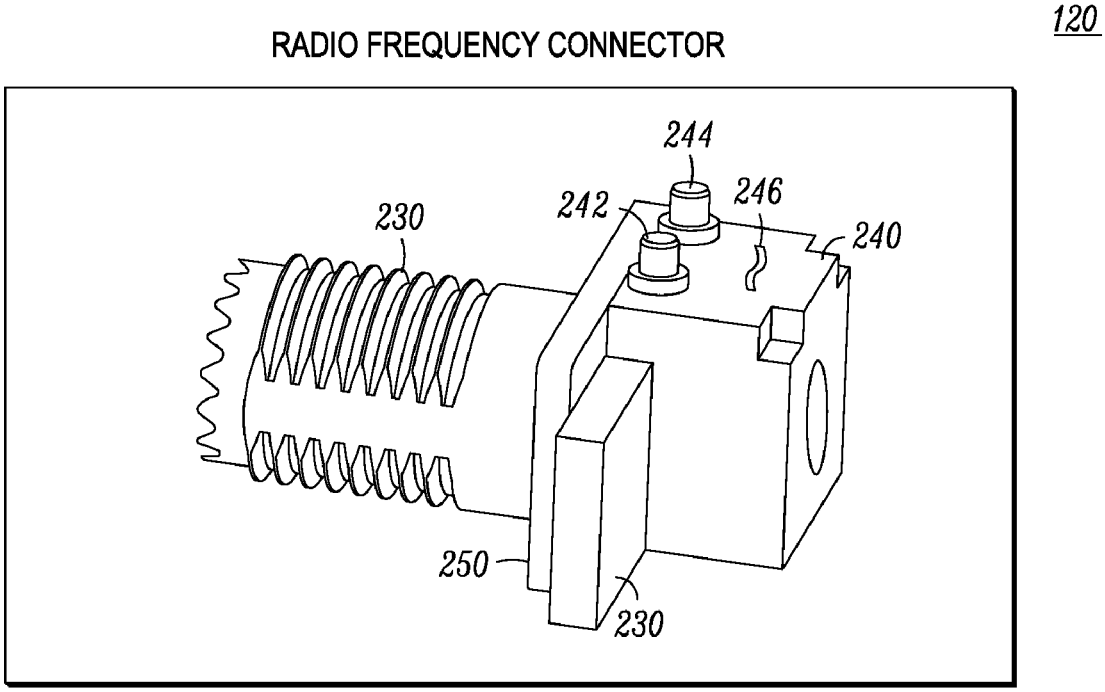
PRIOR ART FIG. 2
FIG. 2 is the internal antenna mounting fixture of the prior art shown in FIG. 1.

While the specification concludes with claims defining the features of the embodiments of the invention that are regarded as novel, it is believed that the method, system, and other embodiments will be better understood from a consideration of the following description in conjunction with the drawing figures, in which like reference numerals are carried forward.

As required, detailed embodiments of the present method and system are disclosed herein. However, it is to be understood that the disclosed embodiments are merely exemplary, which can be embodied in various forms. Therefore, specific structural and functional details disclosed herein are not to be interpreted as limiting, but merely as a basis for the claims and as a representative basis for teaching one skilled in the art to variously employ the embodiments of the present invention in virtually any appropriately detailed structure. Further, the terms and phrases used herein are not intended to be limiting but rather to provide an understandable description of the embodiment herein.

The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

Figure 3:
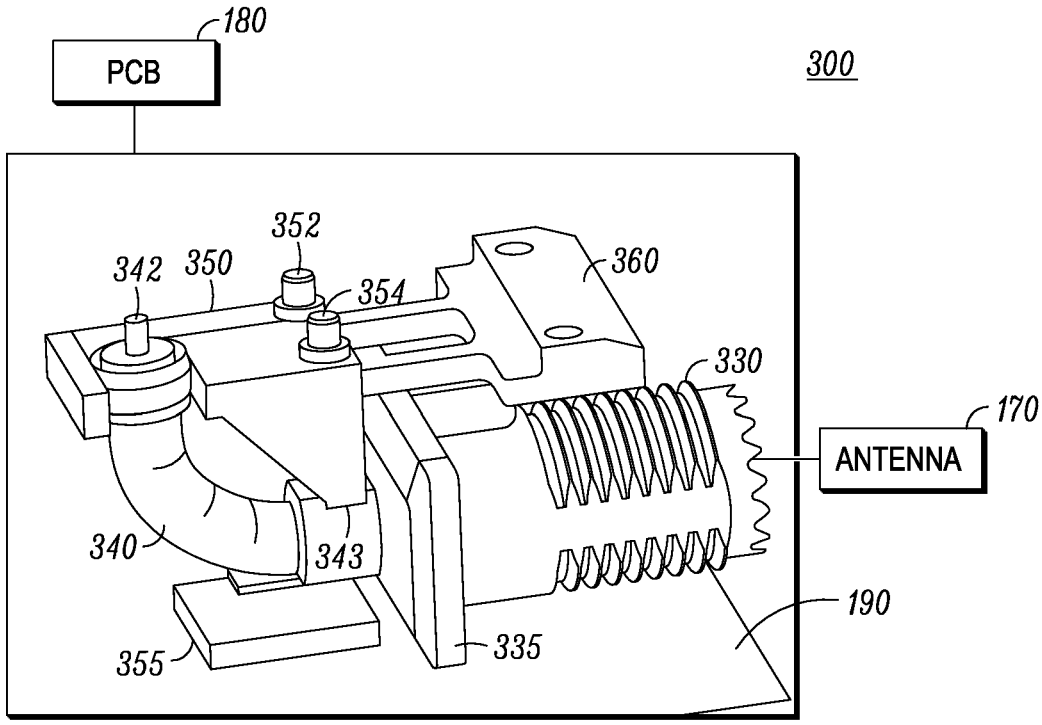
FIG. 3 is a mounting assembly in accordance with an embodiment of the present invention.

Referring to FIG. 3, a mounting assembly 300 for receiving an antenna in accordance with one embodiment is shown. The mounting assembly 300 includes a radio frequency (RF) connector 330 for receiving the antenna 170, a flexible cable 340 connected to the RF connector, and an alignment wall 350 supporting the flexible cable 340. The flexible cable 340 has a first end connected to the RF connector 330, and a second end rigidly connected to the base of the alignment wall 350. The flexible cable 340 provides a flexibility for mounting the RF connector 330 to the mechanical housing 190 and alleviates a solder stress of a base of the alignment wall 350 on the circuit board 190. A temporary reflow support 360 can be used for positioning the mounting assembly 300 on the PCB board during soldering.

The base of the alignment wall 350 is rigidly connected to the PCB 180 for structural support and electrically coupling RF signals received by the antenna 170. The alignment wall 350 also provides a guide channel 343 to receive the flexible cable 340 for flexibly mounting the RF connector 330 to the mechanical housing 190. The guide channel 343 provides a "floating aspect" of the RF connector 330 for coupling to the mechanical housing 190. As an example, the flexible cable 340 can be a coaxial cable with a flexible sheathing for allowing the RF connector 330 to move when mounted to the mechanical housing 190. The flexible cable 340 cable flexibly couples the RF connector 330 to the alignment wall 350, and allows the RF connector 330 to move freely within a limitation established by the guide channel 343 for attachment to the mechanical housing 190. More specifically, the flexible cable 340 allows the RF connector 330 to be non-rigidly connected to the PCB 180. In such regard, the RF connector 330 can freely move to a certain degree within the guide channel 343 for connecting to the housing 190. The RF connector 330 then floats in the alignment wall 350 for receiving the antenna 170 during mounting, and can adjust in an up-down, left-right, or forward-backward direction for receiving the antenna 170.

The RF connector 330 receives the antenna 170 and provides a RF signal connection from the antenna 170 to the PCB 180 through the flexible cable 340. The flexible cable 340 attaches to the alignment wall 350 and provides an electrical connection from the antenna 170 to the PCB 180. An antenna signal can be presented through the flexible cable 340 to the signal pin 342 electrically coupled to the PCB 180. The alignment wall 350 can include structural support pins 352-354 which can also act as ground pins for electrically coupling the antenna 170 the PCB 180. The pins 342, 352, 354 can be at fixed locations on the base of alignment wall 350 for proper mounting to the PCB 180. The mounting assembly 300 can include a flange 335 to secure RF connector 330 to the mechanical housing 190, or chassis of the mobile unit. The secure RF connector 330 can attach to the mechanical housing, such as an aluminum shell of a mobile unit, at the flange 335 for receiving the antenna 170. Notably, the RF connector 330 alleviates solder stress on the PCB 180 due to the floating aspect of the RF connector 330 in the guide channel 343. Moreover, the floating aspect of the RF connector 330 allows slight deviations when the flange 335 is rigidly attached to the mechanical housing 190 of a mobile unit, such as a vehicle mounted radio.

The alignment wall 350 can electrically couple the RF connector 330 and also provide structural support to the RF connector 330 when connected to the mechanical housing 190. The alignment wall 350 can rigidly attach to the PCB 180 internal to the mechanical housing. The alignment wall 350 is adjustable for allowing the RF connector 330 to connect in various arrangements to a mechanical housing for receiving the antenna 170. The alignment wall 350 supports the RF connector 330 in an up-down, left-right, or forward-backward direction for receiving the antenna 170 and alleviating solder stress at the rigid connection of the alignment wall 350 and PCB 180.

Due to the flexible cable 340, the alignment base 350 provides sufficient tolerance when affixing the RF connector 330 to the PCB 180. This allows the RF connector 330, which non-rigidly attaches to the alignment wall 350, to flexibly attach to the mechanical housing. Notably, the location at which the antenna 170 can connect to the RF connector 330 can be slightly adjusted to account for deviations in the mechanical housing of the mobile unit (See FIG. 1). Furthermore, the floating aspect of the mounting assembly 300 reduces impact damage to the PCB 180 when the mobile radio is abruptly moved, or the antenna 170 is pushed in or pulled out.

The mounting assembly 300 can also include a pedestal 355 for pick and placement during industrial assembly and soldering. During assembly, the mounting assembly 300 can be picked up by the pedestal 355 and placed on the PCB 180 at a specific location. For example, a robot can pick up the mounting assembly 300 and position it to a pin layout on the PCB 180 corresponding to the location of the pins (352 354, and 356). The robot can hold the mounting assembly 300 to the PCB 180 while a soldering system solders the pins to the PCB 180.

Figure 4:
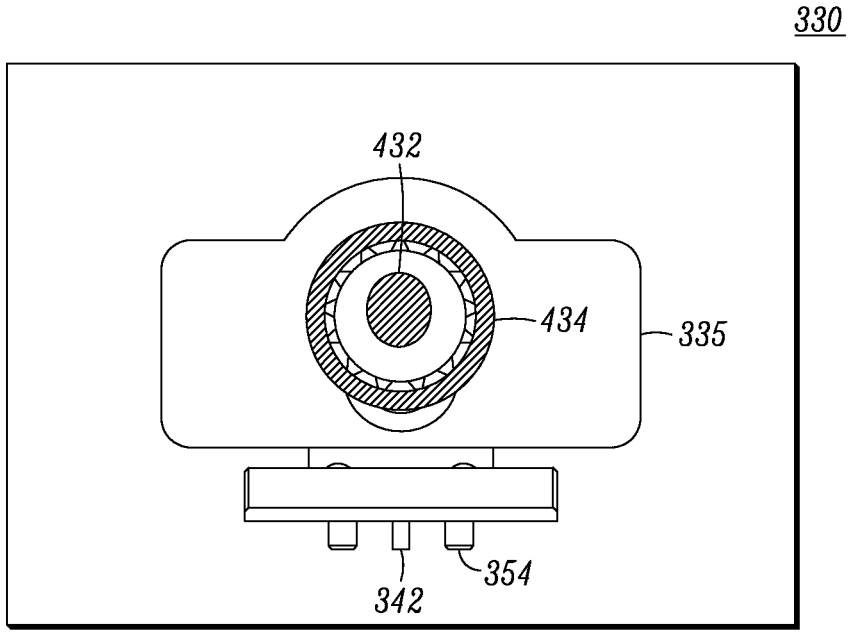
FIG. 4 is a front view of the mounting assembly in accordance with an embodiment of the present invention.

Referring to FIG. 4, a front view of the RF connector 330 is shown. It should be noted that the reflow support 360 can be removed after soldering of the mounting assembly 300 to the PCB 180. In one arrangement, the RF connector 330 can be a threaded assembly that receives a detachable antenna 170. In another arrangement, the RF connector 330 may support a retractable antenna that does not require a threaded attachment. Notably, various other aspects of coupling the RF connector 330 to the antenna are available and herein contemplated.

The RF connector 330 can include a ring 434 that provides a ground path, as a first connection, for the antenna 170 to a ground connection on the PCB 180. Briefly referring back to FIG. 3, the RF connector 330 can move within the guide channel 343 due to the flexible cable 340. When the RF connector 330 and the alignment wall 350 are both made of conductive materials, such as metal, the ring 434 can be electrically coupled to the base of the alignment wall 350. Moreover, the second end of the flexible cable 340 can be soldered to the base of the alignment wall 350 to provide a ground electrical connection. Accordingly, the antenna 170 can be grounded to a ground connection on the PCB 180 through the at least one ground pin (352 or 354) of the alignment wall 350.

Referring back to FIG. 4, the RF connector 330 includes a receiving slot 432 that provides a signal path, as a second connection, of the antenna 170 to the PCB 180 through the flexible cable 340 to the pin 342. For example, the antenna 170 may be configured as a detachable pin and sleeve. The detachable pin (not shown) can be inserted into the receiving slot 432 when the antenna 170 is screwed onto the RF connector 330. The receiving slot 432 electrically couples the antenna 170 to the pin 342 through the flexible cable 340.

Figure 5:
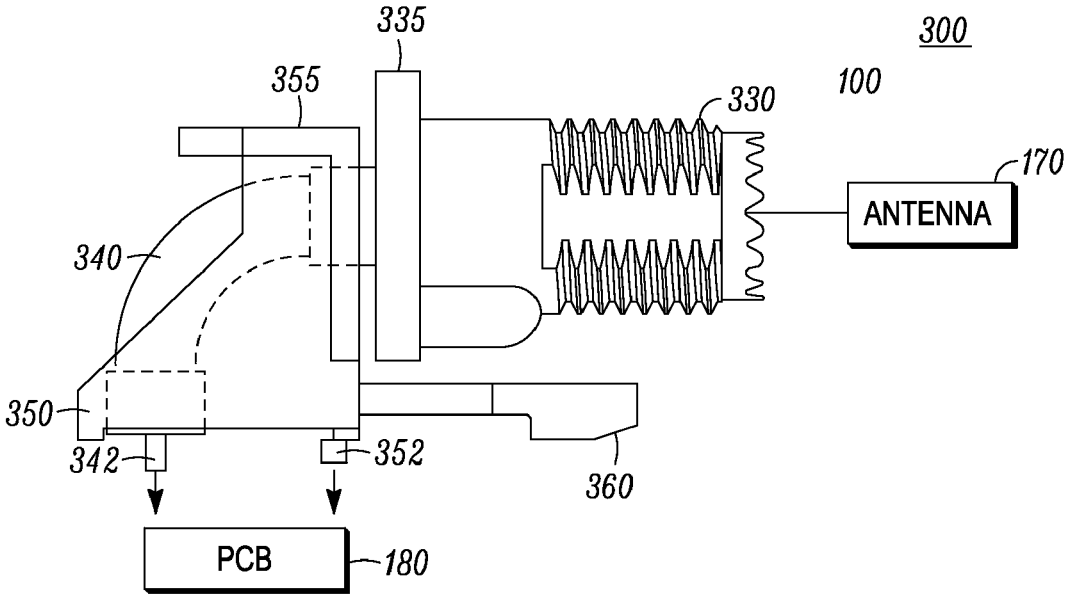
FIG. 5 is a side view of the mounting assembly of FIG. 3 in accordance with an embodiment of the present invention.

Referring to FIG. 5 a side view of the mounting assembly 300 according to one embodiment is shown. The RF connector 330 can receive the antenna 170 and pass the RF antenna signal through the flexible cable 340 to the pin 342 to the PCB board 180. The RF connector 330 can pass a ground path of the antenna 170 through a base portion of the alignment wall 350 to the ground pin 352 to the PCB board 180, as discussed in FIG. 4. As shown in FIG. 5, the alignment wall 350 can also include a reflow support attachable 360 that temporarily holds the mounting assembly 300 during solder reflow. The temporary reflow support 360 holds the mounting assembly 300 on the PCB 180 such that support pins 352 (354) of the alignment wall 350 align with connection points on the PCB 180. The support pins 352-354 can also serve as ground connection pins to the PCB 180. The connection points may be circuit board holes for the ground pins (342 and 354) or may be surface mounted solder connections. The temporary reflow support 360 can be removed after the mounting assembly 300 is soldered to the PCB 180.

Figure 6:
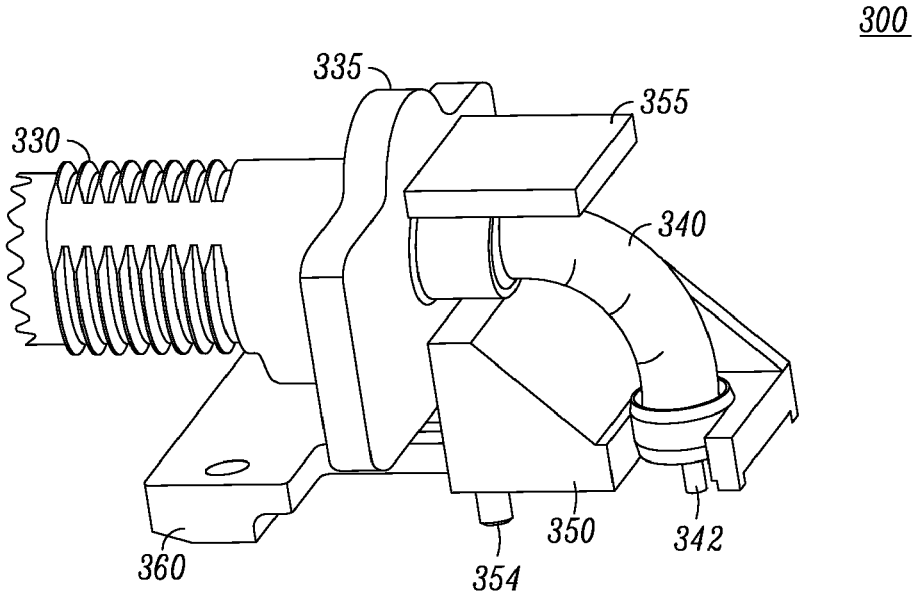
FIG. 6 is an isometric view of the mounting assembly of FIG. 3 in accordance with an embodiment of the present invention.

Referring to FIG. 6, an isometric view of the mounting assembly 300 according to one embodiment is shown. Again, the RF connector 330 can be non-rigidly connected to the PCB 180 through the flexible cable 340 to provide a RF signal to the PCB 180. The flexible cable 340 is attached to the RF connector 330 for providing a floating aspect. Recall, the base of the alignment wall 350 is rigidly connected to the PCB 180 (see FIG. 3) and to a second end of the flexible cable 340. The first end of the flexible cable is non-rigidly connected to the RF connector 330 for providing the floating aspect for mounting the RF connector to the mechanical housing 190.

Figure 7:
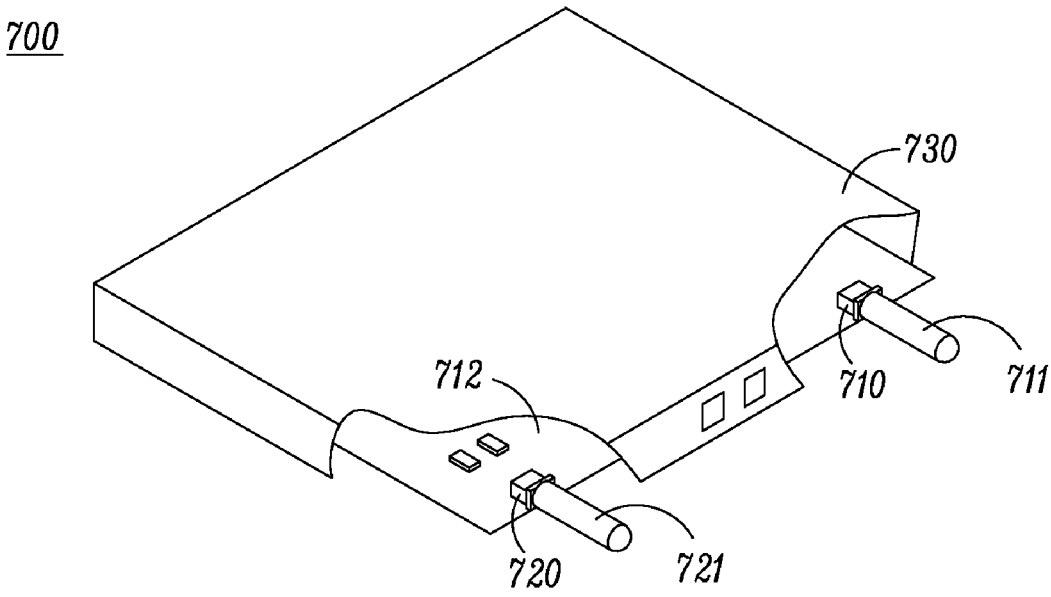
FIG. 7 is a mobile radio having two floating connector assemblies in accordance with an embodiment of the present invention.

FIG. 7 shows a mobile radio 700 have a first floating assembly 710 and a second floating assembly 720 for providing multi-band operation. Notably, the mobile radio 700 may have more that two floating assemblies. The first floating connector assembly 710 can be coupled to the housing 730 and provide non-rigid coupling of a first antenna 711 to the circuit board 712. The second floating connector assembly 720 can also be coupled to the housing 730 and provide non-rigid coupling of a second antenna 721 to the circuit board 712. In another arrangement, there may be two separate circuit boards each receiving a floating connector assembly. Each floating assembly can include a radio frequency (FR) connector (see 330 FIG. 3) extending external to the housing for receiving the corresponding antenna, and a flexible coaxial cable (see 340 FIG. 3) coupled between the corresponding RF connector and the circuit board as discussed in FIG. 3. Each floating connector assembly can include a guide channel (see 343 FIG. 3) that limits the movement of the corresponding flexible coaxial connector within the housing 730 thereby limiting movement of the corresponding RF connector and corresponding antenna extending external to the housing as discussed in FIG. 3. The first 710 and second 720 floating connector assemblies each provide non-rigid coupling of the first and second antennas to the circuit board while limiting movement of the corresponding RF connectors and first 711 and second 712 antennas external to the housing.

While the preferred embodiments of the invention have been illustrated and described, it will be clear that the embodiments of the invention is not so limited. Numerous modifications, changes, variations, substitutions and equivalents will occur to those skilled in the art without departing from the spirit and scope of the present embodiments of the invention as defined by the appended claims.

What is claimed is:

1. A floating assembly for an antenna comprising:

a mechanical housing;

a printed circuit board (PCB) disposed within said mechanical housing;

a radio frequency (RF) connector attached to said mechanical housing;

said antenna for connecting to said RF connector;

a flexible cable; and an alignment wall for receiving and supporting said flexible cable;

wherein said flexible cable is attached to said RF connector for providing an electrical connection from said antenna to said PCB, and wherein said alignment wall is mounted to the PCB, said alignment wall having a guide channel such that said flexible cable is freely moving within said guide channel when said RF connector is mounted to said mechanical housing.

2. The floating assembly of claim 1, wherein the alignment wall and guide channel provide a tolerance limit within which the flexible cable can move.

3. The floating assembly of claim 2, wherein the flexible cable provides flexibility of movement for mounting the RF connector to the mechanical housing, and guide channel of the alignment wall limits the movement of flexible cable thereby limiting movement of the RF connector to within the tolerance limit of the guide channel.

4. The floating assembly of claim 3, wherein the flexible cable moves within a guide channel of the alignment wall and the RF connector floats external to the alignment wall for receiving the antenna.

5. The floating assembly of claim 3, wherein the alignment wall alleviates solder stress on the circuit board by floating the RF connector within the guide channel.

6. The floating assembly of claim 1, wherein the alignment wall provides a pedestal for pick and placement of the floating assembly to said printed circuit board.

7. The floating assembly of claim 1, wherein the alignment wall includes a detachable reflow support.

8. The floating assembly of claim 1, wherein the alignment wall is rigidly connected to said circuit board for electrically coupling RF signals received by the antenna.

9. The floating assembly of claim 7, wherein the RF connector provides a ground path of the antenna to said circuit board through at least one ground pin of the alignment wall.

10. The floating assembly of claim 7, wherein the RF connector provides a signal path of the antenna to said circuit board through the flexible cable.

11. A mounting assembly, comprising:

a mechanical housing;

a printed circuit board (PCB) disposed within said mechanical housing;

a radio frequency (RF) connector attached to said mechanical housing;

an antenna for connecting to said RF connector;

a flexible cable; and an alignment wall for receiving and supporting said flexible cable;

wherein said flexible cable is attached to said RF connector that provides electrical connection from said antenna to said printed circuit board (PCB), and wherein said alignment wall mounts to the PCB, the alignment wall having a guide channel such that the flexible cable is freely moving within said guide channel when said RF connector is mounted to said mechanical housing.

12. The mounting assembly of claim 11, wherein the mounting assembly reduces solder stress of the alignment wall on the PCB.

13. The mounting assembly of claim 11, wherein the flexible cable provides for a floating of the RF connector in an up-down, left-right, or forward-backward direction.

14. The mounting assembly of claim 11, wherein the RF connector attaches to the mechanical housing of a mobile unit and provides mechanical displacement variability for receiving the antenna due the flexible cable.

15. The mounting assembly of claim 11, further comprising a reflow support attachable to the alignment wall that temporarily holds the RF mounting assembly during solder reflow.

16. The mounting assembly of claim 11, wherein the alignment wall electrically couples a ground path of the antenna to the PCB.

17. A floating connector assembly, comprising:

a mechanical housing, a circuit board disposed within said mechanical housing, an antenna, a RF connector for receiving said antenna and attaching to said mechanical housing, a flexible cable, and an alignment wall, said flexible cable having a first end connected to the RF connector; and said alignment wall that rigidly connects a second end of the flexible cable to said circuit board, wherein the alignment wall includes a guide channel such that the first end of the flexible cable is freely moving within the guide channel when the RF connector attaches to said mechanical housing.

18. The floating connector assembly of claim 17, wherein the flexible cable provides a flexibility for mounting the RF connector to the mechanical housing and alleviates a solder stress of a base of the alignment wall on the circuit board.

19. A mobile radio comprising:

a housing;

a circuit board disposed within the housing;

a first floating connector assembly attaching to said housing;

a flexible coaxial cable;

a first antenna; and said first floating connector assembly providing non-rigid coupling of the first antenna to the circuit board, the first floating connector assembly including an alignment wall with a guide channel formed therein for receiving and supporting said flexible coaxial cable wherein the first floating connector assembly further includes a radio frequency (RF) connector extending external to the housing for receiving the antenna; and the flexible coaxial cable being coupled between the RF connector and the circuit board.

20. The mobile radio of claim 19, wherein the guide channel limiting limits the movement of the flexible coaxial cable within the housing thereby limiting movement of the RF connector and the antenna extending external to the housing.

21. The mobile radio of claim 20, further comprising:

a second floating connector assembly coupled within the housing for receiving a second antenna to provide multi-band operation to the mobile radio, the second floating connector assembly including an alignment wall with guide channel formed therein and through which a flexible coaxial cable is received which connects to the second antenna.

22. The mobile radio of claim 21, wherein the first and second floating connector assemblies each provide non-rigid coupling of the first and second antennas to the circuit board while limiting movement of the RF connectors and first and second antennas external to the housing.

* * * * *

UNITED STATES PATENT AND TRADEMARK OFFICE

CERTIFICATE OF CORRECTION

PATENT NO. : 7,796,094 B2
APPLICATION NO. : 11/694851
DATED : September 14, 2010
INVENTOR(S) : Mtchedlishvili et al.

It is certified that error appears in the above-identified patent and that said Letters Patent is hereby corrected as shown below:

In Column 4, Line 59, delete "(352 354," and insert -- (352, 354, --, therefor.

In Column 7, Line 34, in Claim 14, delete "due the" and insert -- due to the --, therefor.

Signed and Sealed this
Thirty-first Day of July, 2012

David J. Kappos

David J. Kappos
*Director of the United States Patent and Trademark Office*